US006253655B1

(12) United States Patent
Lyons et al.

(10) Patent No.: US 6,253,655 B1
(45) Date of Patent: Jul. 3, 2001

(54) LIGHTWEIGHT ARMOR WITH A DURABLE SPALL COVER

(75) Inventors: Fielder Stanton Lyons, Phoenix; Jeffrey Alan Mears, Chandler, both of AZ (US)

(73) Assignee: Simula, Inc., Phoenix, AZ (US)

( * ) Notice: Subject to any disclaimer, the term of this patent is extended or adjusted under 35 U.S.C. 154(b) by 0 days.

(21) Appl. No.: 09/251,736

(22) Filed: Feb. 18, 1999

(51) Int. Cl.[7] ..... F41H 5/02
(52) U.S. Cl. ..... 89/36.02
(58) Field of Search ..... 89/36.02, 36.05, 89/36.07, 36.08, 36.11, 36.13; 428/911; 2/2.5

(56) References Cited

U.S. PATENT DOCUMENTS

| | | | | |
|---|---|---|---|---|
| 3,559,210 | * | 2/1971 | Hansen | 2/2.2 |
| 3,873,998 | * | 4/1975 | Norris et al. | 2/2.5 |
| 4,413,357 | * | 11/1983 | Sacks | 2/2.5 |
| 4,664,967 | | 5/1987 | Tasdemiroglu | 428/220 |
| 4,739,690 | | 4/1988 | Moskowitz | 89/36.02 |
| 4,774,724 | * | 10/1988 | Sacks | 2/2.5 |
| 4,861,666 | | 8/1989 | LeGrand et al. | 428/412 |
| 4,876,941 | | 10/1989 | Barnes et al. | 89/36.02 |
| 4,934,245 | | 6/1990 | Musante et al. | 89/36.02 |
| 4,989,493 | | 2/1991 | Blommer et al. | 89/36.02 |
| 5,179,244 | | 1/1993 | Zufle | 89/36.02 |
| 5,317,950 | * | 6/1994 | Binon et al. | 89/36.02 |
| 5,349,893 | | 9/1994 | Dunn | 89/36.05 |
| 5,364,679 | | 11/1994 | Groves | 428/76 |
| 5,402,703 | | 4/1995 | Drotleff | 89/36.02 |
| 5,547,536 | | 8/1996 | Park | 156/292 |
| 5,705,764 | | 1/1998 | Schade et al. | 89/36.02 |
| 5,767,435 | | 6/1998 | Reyman | 89/36.02 |
| 5,887,453 | * | 3/1999 | Woods | 66/171 |
| 5,918,309 | * | 7/1999 | Bachner | 2/2.2 |

OTHER PUBLICATIONS

American Society for Testing and Materials, Designation D 1056, "Standard Specification for Flexible Cellular Materials–Sponge or Expanded Rubber," 1998.

* cited by examiner

*Primary Examiner*—Charles T. Jordan
*Assistant Examiner*—Francis T. Palo
(74) *Attorney, Agent, or Firm*—Shaw Pittman

(57) ABSTRACT

A lightweight armor having a durable spall cover for suppressing debris that would otherwise be ejected from the armor as a result of the impact of a projectile or missile on the lightweight armor. In addition, the invention allows a ceramic or ceramic-based composite armor panels to be dropped onto a concrete surface without sustaining any damage to the ceramic tile. A preferred embodiment of the present invention is a laminate comprising a polymer sheet outer layer, a flexible foam sheet or flexible honeycomb inner layer, a ceramic-based armor plate, and a fiber-reinforced plastic laminate backing, as well as adhesive layers bonding each of the main layers to its adjacent layer or layers. When an object impacts the polymer sheet outer layer, the impact force is distributed by the polymer sheet outer layer to the flexible foam inner layer that in turn absorbs some of the kinetic energy. When a ballistic projectile such as a bullet strikes the polymer sheet, it perforates the polymer sheet and is defeated by the armor plate. The flexible foam inner layer and the polymer sheet outer layer would also suppress the resultant spall from ejecting out of the armor.

23 Claims, 3 Drawing Sheets

LIGHTWEIGHT ARMOR WITH A DURABLE SPALL COVER

FIELD OF THE INVENTION

The present invention relates to lightweight armor having a durable spall cover for suppressing debris that would otherwise be ejected from the armor as a result of the impact of a projectile or missile on the lightweight armor.

BACKGROUND OF THE INVENTION

Lightweight armors utilizing a hard strike face component such as a ceramic or ceramic matrix composite are susceptible to damage during use. In addition, these types of armors also eject spall (i.e., ceramic debris) from the front face upon being impacted by a projectile. The spall can be hazardous to surrounding personnel.

Prior art spall shields include nylon cloth, rubber, metal, or resin impregnated glass fabric bonded to the exterior surface of the armor (ceramic) or a resin film cured and formed to the outside of the armor. None of these prior art spall shields provide complete spall suppression and only provide a very limited amount of protection for the hard (ceramic) front component of the armor (e.g., if the armor is dropped onto a hard surface).

U.S. Pat. No. 4,664,967 (Tasdemiroglu) discloses a ballistic spall liner for military vehicles. It discloses a liner with multiple and repeating layers made of high tensile strength fabric and steel. The object of the invention is to prevent military personnel within a military vehicle from being injured by spall that is directed to them in the same general direction of the projectile.

U.S. Pat. No. 4,876,941 (Barnes et al.) discloses a composite for protection against armor-piercing projectiles. This patent discloses how to make a composite. It does not teach how to trap the spall created as a result of an impact on the composite by a projectile. U.S. Pat. No. 4,989,493 (Blommer et al.) discloses an explosive attenuating structure for use inside missiles and the like. U.S. Pat. No. 4,739,690 (Moskowitz) discloses a ballistic armor with a spall shield containing an outer layer of plasticized resin.

SUMMARY OF THE INVENTION

The invention uses a combination of materials to provide a unique level of high durability and high spall suppression not provided by the prior art.

The present invention allows the ceramic or ceramic-based composite armor panels to be dropped up to four feet onto a concrete surface with the ceramic face down and 40 pounds attached to the back face without any damage to the ceramic. Furthermore, the invention reduces spall (frontal ejection of ceramic/projectile debris) to a degree not obtained using the standard methods disclosed in the prior art that uses single or multiple plies of nylon fabrics (e.g., military specification fabric MIL-C-12369).

The present invention uses a spall cover to protect the impact face of light weight armor products from being damaged during normal use, and to protect damage to people or equipment if the armor is hit with a high-impact projectile or missile, such that debris is ejected from the front surface of the armor. The invention can be used as an insert to body armor, and the spall cover could also be used as an additional cover on any existing ceramic-based armor systems.

A preferred embodiment of the present invention is a laminate comprising the following main layers: a hard polymer sheet outer layer, a flexible foam sheet or flexible honeycomb inner layer, an armor plate, and a fiber-reinforced plastic laminate backing, as well as adhesive layers bonding each of the main layers to its adjacent layer or layers.

The purpose of the invention is to provide complete spall suppression and durability for the ceramic armor. That is, no spall shall be ejected from the front surface of the armor, upon ballistic impact, with sufficient force to perforate an aluminum witness sheet. Also, the invention shall provide durability to the armor such that the armor will be capable of being dropped several times with the armor strike face down onto a concrete surface without causing significant damage to the armor, i.e., damage that would degrade the ballistic performance of the armor laminate. The principal use of the present invention is as a body armor insert, or with other protective shields used for personal protection.

OBJECTS OF THE INVENTION

It is an object of the present invention to provide additional protection by reducing the injury and damage that would otherwise be caused by the ejection of spall from the front surface of armor.

It is a further object of the present invention to provide a durable spall cover which protects the ceramic component in a lightweight armor system.

It is a further object of the present invention to provide an effective lightweight cover for lightweight ceramic-based armor.

It is a further object of the present invention to provide an impact-protection cover for the ceramic-based armor.

DETAILED DESCRIPTION OF THE INVENTION

Figure 1:
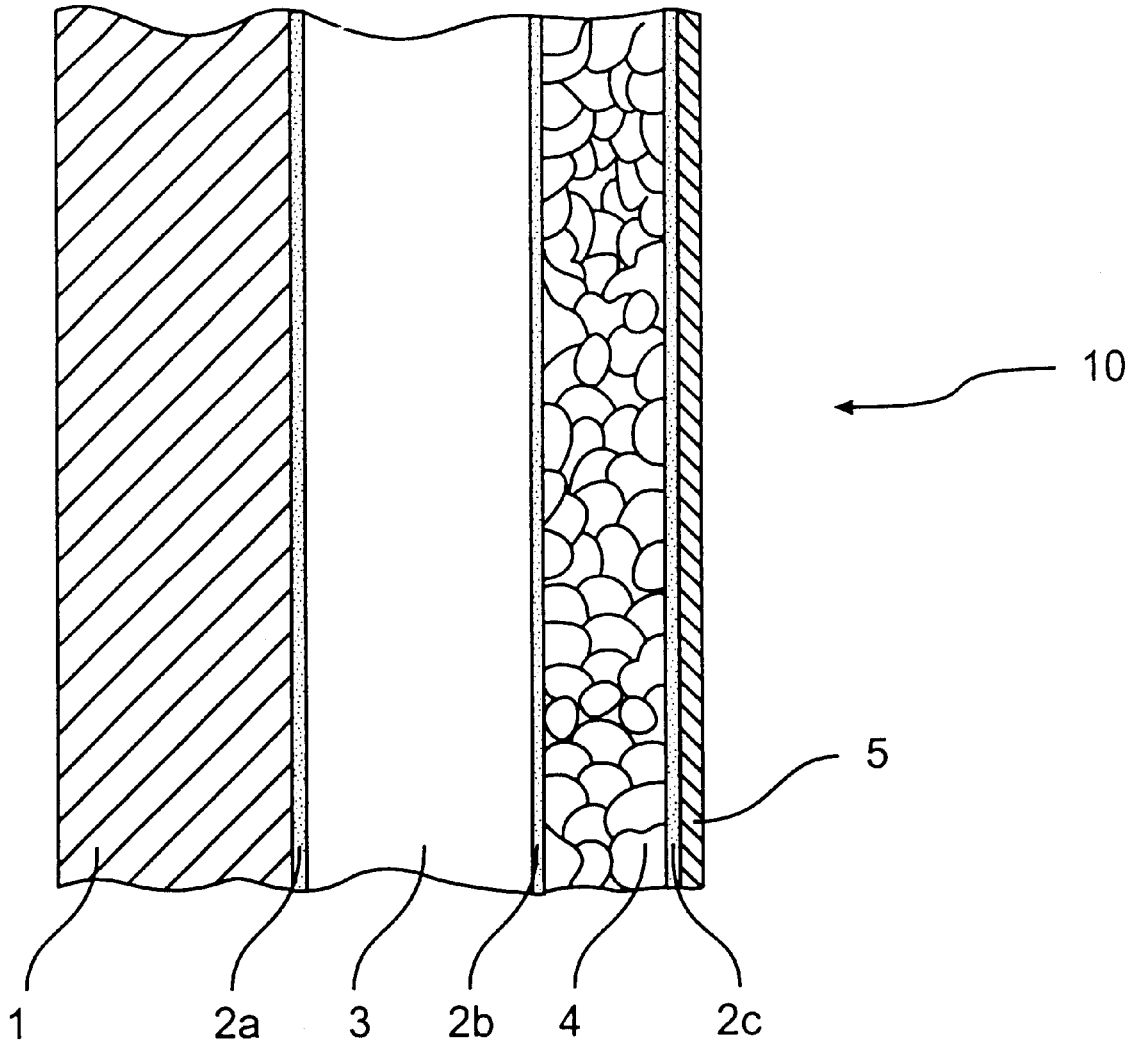
FIG. 1 is a schematic diagram of a cross-section of a preferred embodiment of the present invention.

FIG. 1 is a cross section of a preferred embodiment of the present invention. As shown in FIG. 1, the first preferred embodiment is an armor that includes a fiber-reinforced laminate backing 1; an adhesive layer 2*a* (e.g., a rubber-based contact adhesive or a polyurethane film); an armor plate 3 (such as ceramic or ceramic matrix composite tile); a second adhesive layer 2*b*; a flexible inner layer 4 (e.g., a nitrile/polyvinyl chloride (PVC) foam or a flexible honeycomb structure) having a low density cellular core forming a rigid sponge foam with the cells connected or interconnected; a third adhesive layer 2*c*; and a hard polymer sheet outer layer 5 (e.g., high impact polystyrene). For parts with complex curvature, the polymer sheet outer layer 5 should be pre-formed to the proper shape prior to bonding.

Figure 2:
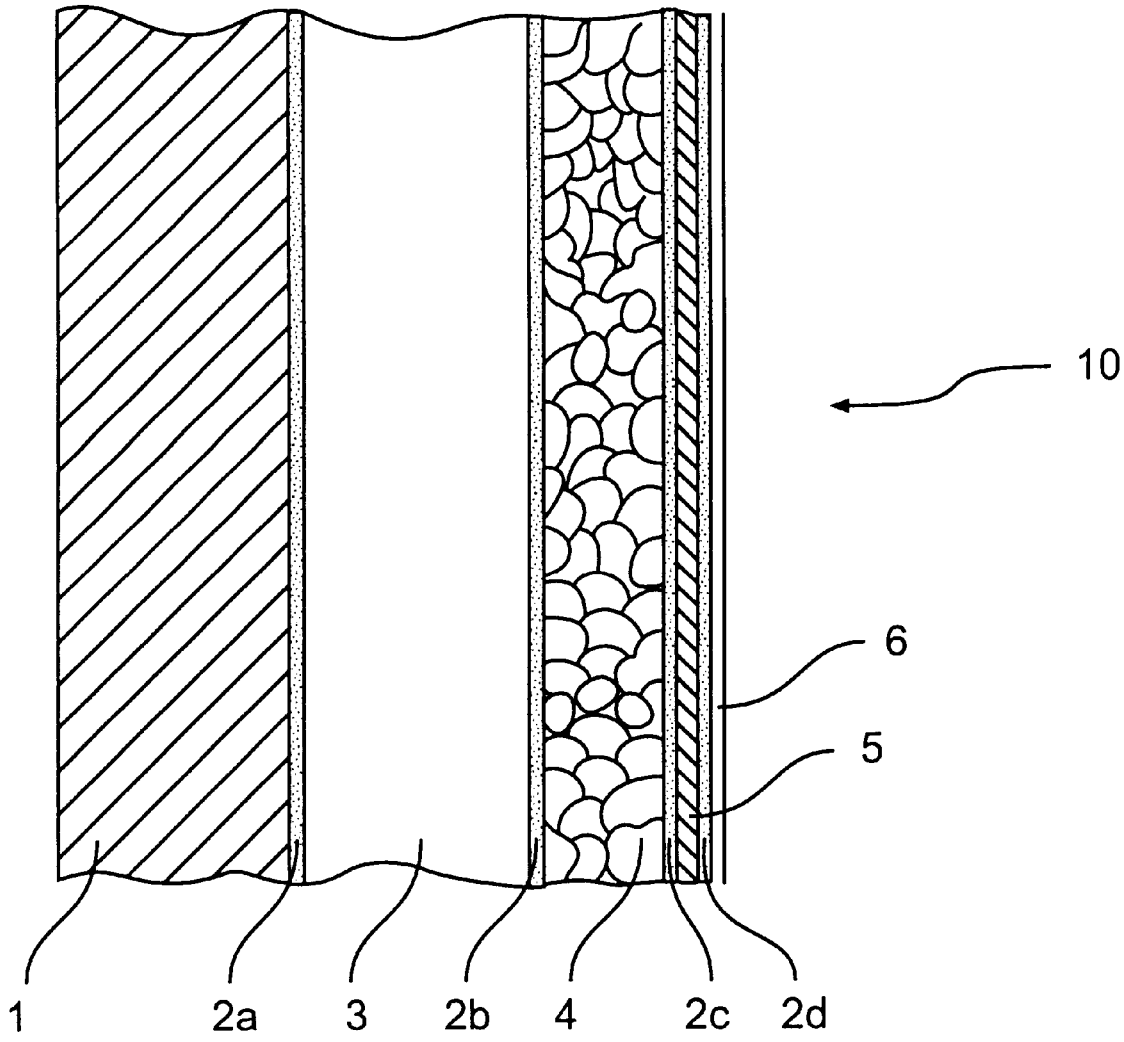
FIG. 2 is a schematic diagram of a cross-section of another preferred embodiment of the present invention.
Figure 3:
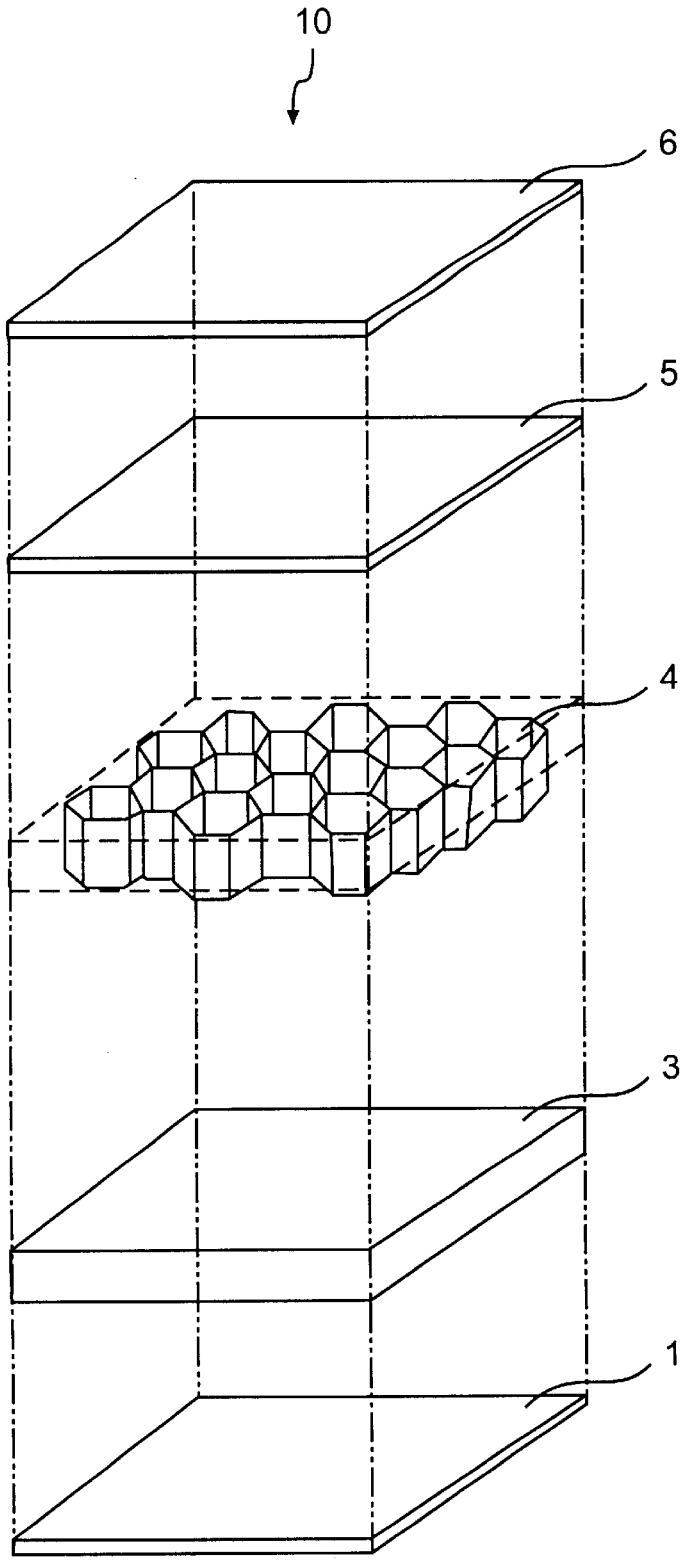
FIG. 3 is an exploded, isometric view of a portion of a preferred embodiment of the present invention.

Another preferred embodiment is shown in FIG. 2. It is similar to the embodiment shown in FIG. 1, but it includes a fourth adhesive layer 2*d*, and a nylon fabric cover 6. Nylon fabric cover 6 provides environmental protection for the spall cover.

When an armor of this invention is impacted or dropped (with a force acting in direction 10 shown in FIGS. 1 and 2), the polymer sheet outer layer 5 of the present invention transfers and distributes the load of the impact over a large area to the foam inner layer 4. The impact then compresses foam inner layer 4, and the kinetic energy of the impact is absorbed by foam inner layer 4. As a result, armor plate 3 is protected from damage.

When the armor is struck with a ballistic projectile such as a bullet (as shown in direction 10 in FIGS. 1 and 2), spall, i.e., fragments and debris from the front surface of the armor, are ejected into both the flexible inner layer 4 and the polymer sheet outer layer 5. These layers work together to trap the spall and slow it down such that it does not perforate a 0.020-inch thick sheet of 2024 aluminum. Spall that does not penetrate through this thickness of aluminum would likely not cause any more than minor injuries to persons close to the body armor. For example, when a 30-caliber armor-piercing hard steel round from a rifle at a muzzle velocity of 2850 feet per second impacts the armor of the present invention, the spall ejected would not penetrate the 0.020-inch thick aluminum witness sheet.

The preferred material for the foam inner layer 4 is nitrile/PVC, as described in ASTM D 1056-98. The preferred thickness of the foam inner layer is about 0.25-inch thick. Alternate materials for the foam inner layer 4 include polyethylene, polyurethane, rate sensitive foam (such as Simula Part No. 102228 foam, Simula, Inc., Phoenix, Arizona), and flexible honeycomb. The preferred honeycomb has a hexagonal structure, is made from polyurethane and has a 0.375-inch cell size, 0.25-inch thick polyurethane walls, with 0.005-inch to 0.010-inch skin surfaces at opposite ends of the structure. The skin surfaces are perpendicular to the polyurethane walls.

The preferred material for the polymer sheet outer layer 5 is high impact polystyrene that is about 0.04-inch thick. Alternate materials for the polymer outer layer 5 include Acrylonitrile-Butadiene-Styrene (ABS), polycarbonate, polypropylene, fiberglass laminate, and Kevlar® laminate. The preferred thickness for any of these alternate materials is also about 0.04-inch.

Although FIGS. 1 and 2 show armor plates and spall covers with a flat configuration, the present invention can be implemented with armor parts having curved or angular surfaces. In that case, the hard polymer sheet outer layer 5 and/or the armor plate(s) 3 are preformed to the desired curved or angular shape prior to bonding the layers together. The other layers are flexible, such that they will assume the desired shape when they are bonded to the preformed plastic outer surface and/or to the armor plate(s).

What we claim is:

1. A lightweight armor comprising:

(a) a fiber-reinforced plastic laminate backing having a first surface and a second surface;

(b) a ceramic tile layer a first surface of which is attached to the second surface of said fiber-reinforced plastic laminate backing;

(c) a flexible inner layer a first surface of which is attached to a second surface of said ceramic tile layer; and (d) a hard plastic outer layer a first surface of which is attached to a second surface of said flexible inner layer, wherein said hard plastic outer layer is selected from the group consisting essentially of polystyrene, acrylonitrile-butadiene-styrene, polycarbonate, polypropylene, and fiberglass laminate, and wherein a second surface of said hard plastic outer layer faces a force striking said lightweight armor.

2. The lightweight armor of claim 1, further comprising rubber-based contact adhesive layers that bond said fiber-reinforced plastic laminate backing, said ceramic tile layer, said flexible inner layer, and said hard plastic outer layer.

3. The lightweight armor of claim 1, further comprising a nylon fabric cover a first surface of which is attached to the second surface of said hard plastic outer layer, wherein a second surface of said nylon fabric cover faces the force striking said lightweight armor.

4. The lightweight armor of claim 3, wherein a rubber-based contact adhesive is used to attach said hard plastic outer layer to said nylon fabric cover.

5. The lightweight armor of claim 1, wherein said flexible inner layer has a honeycomb structure.

6. A lightweight armor laminate comprising:

(a) a fabric cover;

(b) a hard polymer sheet outer layer adhesively attached to said fabric cover;

(c) a flexible inner layer adhesively attached to said hard polymer sheet outer layer; and (d) an armor plate adhesively attached to said flexible inner layer, wherein said armor plate does not come into contact with said hard polymer sheet outer layer, and wherein said nylon fabric cover is exposed to a force striking said lightweight armor laminate.

7. The lightweight armor laminate of claim 6, further comprising a fiber-reinforced backing adhesively attached to said armor plate on the side of said armor plate opposite to said flexible inner layer.

8. The lightweight armor laminate of claim 6, wherein said flexible inner layer comprises a low density cellular core.

9. The lightweight armor laminate of claim 8, wherein said flexible inner layer has a honeycomb structure.

10. The lightweight armor laminate of claim 6, wherein said armor plate is a ceramic plate, and wherein said lightweight armor can be dropped four feet to a hard concrete surface with said fabric cover faces the hard concrete surface without suffering significant damage.

11. A durable spall cover for an armor plate comprising:

(a) a flexible inner layer a first surface of which comes into contact with said armor plate; and (b) a hard polymer sheet outer layer adhesively attached to a second surface of said flexible inner layer, wherein said durable spall cover protects said armor plate such that said armor plate can be dropped from a height of four feet onto a concrete surface without suffering significant damage, and wherein said hard polymer sheet outer layer does not come into contact with said armor plate.

12. The durable spall cover of claim 11, wherein said flexible inner layer is a nitrile/polyvinyl chloride foam.

13. The durable spall cover of claim 11, wherein said flexible inner layer has a honeycomb structure.

14. The durable cover of claim 11, wherein said hard polymer sheet outer layer is selected from the group consisting essentially of polystyrene, acrylonitrile-butadiene-styrene, polycarbonate, polypropylene, and fiberglass laminate.

15. The durable spall cover of claim 11, wherein the hard polymer sheet outer layer is preformed to match the shape of the armor plate.

16. A durable spall cover for an armor plate comprising:

(a) a flexible inner layer a first surface of which comes into contact with said armor plate; and (b) a hard polymer sheet outer layer adhesively attached to a second surface of the flexible inner layer, wherein said durable spall cover suppresses spall that is ejected during an impact on said armor plate by a 30-caliber round from a rifle at a muzzle velocity no greater than 2850 feet per second such that ejected spall, if any, would not penetrate a 0.020-inch 2024 aluminum witness sheet, and wherein said hard polymer sheet outer layer does not come into contact with said armor plate.

17. The durable spall cover of claim 16, wherein said flexible inner layer comprises a low density cellular core.

18. The durable spall cover of claim 17, wherein said flexible inner layer has a honeycomb structure.

19. The durable spall cover of claim 16, wherein said flexible inner layer is selected from the group consisting essentially of polyurethane and nitrile/polyvinyl chloride foam.

20. The durable spall cover of claim 16, wherein said hard polymer sheet outer layer is selected from the group consisting essentially of polystyrene, acrylonitrile-butadiene-styrene, polycarbonate, polypropylene, and fiberglass laminate.

21. A lightweight armor comprising:

(a) a fiber-reinforced plastic laminate backing having a first surface and a second surface;

(b) a ceramic tile layer a first surface of which is attached to the second surface of said fiber-reinforced plastic laminate backing;

(c) a flexible inner layer a first surface of which is attached to a second surface of said ceramic tile layer, wherein the flexible inner layer has a honeycomb structure; and (d) an outer layer a first surface of which is attached to a second surface of said flexible inner layer, wherein a second surface of said outer layer faces a force striking said lightweight armor.

22. The lightweight armor of claim 21, wherein the outer layer is selected from the group consisting essentially of polystyrene, acrylonitrile-butadiene-styrene, polycarbonate, polypropylene, fiberglass laminate, and Kevlar®.

23. The lightweight armor of claim 21, further comprising a fabric cover, wherein the fabric cover is attached to the outer layer.

* * * * *